United States Patent [19]

Diggs

[11] 3,950,874

[45] Apr. 20, 1976

[54] UNIVERSAL MOUNTING BRACKET FOR SIGNS

[76] Inventor: Richard E. Diggs, 12 A Road, Carthage, Mo. 64836

[22] Filed: Feb. 13, 1975

[21] Appl. No.: 549,557

[52] U.S. Cl. ..... 40/145 R; 40/125 H; 248/540; 248/539

[51] Int. Cl.[2] ..... G09F 7/20

[58] Field of Search..... 40/145 R, 145 A, 125 H, 40/125 K, 125 N, 125 R; 248/43, 41, 226 D, 226 C, 230, 221; 211/107

[56] References Cited

UNITED STATES PATENTS

| | | | |
|---|---|---|---|
| 1,438,534 | 12/1922 | Kuen | 248/226 D |
| 1,525,515 | 2/1925 | Socha | 248/41 |
| 1,535,396 | 4/1925 | Buehler | 248/43 X |
| 1,706,509 | 3/1929 | Woolf | 248/230 X |
| 2,050,779 | 8/1936 | Blanchard | 40/145 R UX |
| 3,289,982 | 12/1966 | Hart | 248/41 |
| 3,358,952 | 12/1967 | Burns | 248/43 |
| 3,613,896 | 10/1971 | Miller | 211/107 |

FOREIGN PATENTS OR APPLICATIONS

| | | | |
|---|---|---|---|
| 11,110 | 1908 | United Kingdom | 248/43 |

*Primary Examiner*—Louis G. Mancene
*Assistant Examiner*—John F. Pitrelli
*Attorney, Agent, or Firm*—Shoemaker and Mattare, Ltd.

[57] ABSTRACT

A universal mounting bracket for attachment to supports of various configurations and sizes comprises opposite side portions integrally joined together at one of their ends and spaced apart at their other ends, said side portions having a plurality of differently shaped and sized support gripping configurations therein to grip different size and shape supports to enable the bracket to be quickly and easily mounted on various supports, and the side portions have angularly disposed surfaces thereon carrying desired insignia, whereby to increase the visibility of the insignia to approaching motorists and the like.

6 Claims, 11 Drawing Figures

UNIVERSAL MOUNTING BRACKET FOR SIGNS

BACKGROUND OF THE INVENTION

This invention relates to a unique universal mounting bracket for signs and the like, and particularly to a universal mounting bracket having angularly disposed surfaces thereon carrying suitable indicia, such as reflective surfaces for use as a highway sign or the like to indicate to approaching motorists where a side road enters and leaves another road on which the motorist is travelling. The mounting bracket has a plurality of different sized and shaped configurations therein for gripping an upright support, such as a post, rod or pipe or the like, to support the insignia or indicia in proper position.

Although the mounting bracket of the present invention has utility in many applications, it is particularly suitable for supporting highway safety signs in position. Under conditions of inclement weather or under conditions of low visibility, such as at night or in fog, rain or snow and the like, it is difficult for motorists to determine the location of intersections of secondary roads and private drives and the like with the road on which they are travelling. These visual difficulties cause erratic and unpredictable driving, resulting in many accidents, particularly where the motorist desires to turn left across the other lane of traffic into an intersecting road. The unique bracket of the present invention is exceptionally quick and easy to install, and has suitable insignia thereon to indicate to a motorist exactly where the location of an intersecting roadway or drive and the like is, and in addition, suitable insignia may be provided on the bracket to indicate what type of exit or intersection the motorist is approaching, and the motorist is, therefore, enabled to make a normal, smooth deceleration and turn even under the most adverse visual conditions.

OBJECTS OF THE INVENTION

It is an object of this invention to provide a universal mounting bracket for signs and the like, which is quickly and easily attachable to many different types of supports, and without requiring the use of separate fasteners and the like.

Another object of this invention is to provide a mounting bracket having suitable indicia or insignia thereon, wherein the mounting bracket has structure enabling it to be quickly and easily mounted on a support in a position such that the insignia is readily visible to a motorist approaching an intersection to indicate to the motorist precisely where the location of the intersection is, so that the motorist is enabled to make a smooth and predictable turn into the intersection.

DETAILED DESCRIPTION OF THE INVENTION

Figure 1:
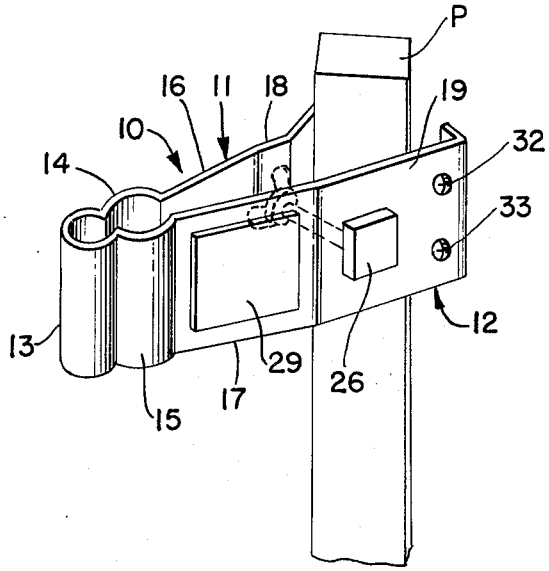
FIG. 1 is a top perspective view of the bracket in accordance with the invention, showing one form of insignia thereon, and with the bracket attached to a first type of support.
Figure 2:
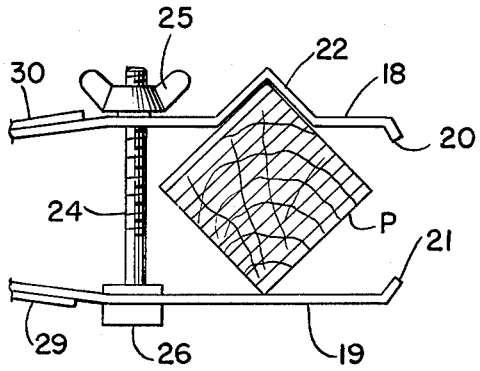
FIG. 2 is an enlarged view in section taken along line 2—2 in FIG. 1.
Figure 3:
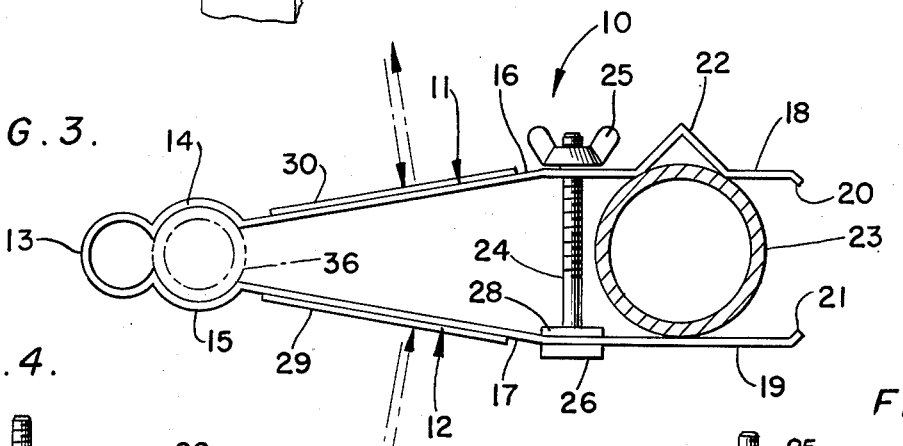
FIG. 3 is an enlarged plan view of the bracket of the invention attached to a second type of support.

In the drawings, wherein like reference numerals indicate like parts throughout the several Figures, a bracket 10 according to the invention is shown in FIGS. 1 and 2 attached to an upright post P, such as a two-by-two or the like, and the bracket 10 comprises opposite side portions 11 and 12 integrally joined at one of their ends by a substantially cylindrically shaped gripping configuration 13 and spaced apart at their other ends. The side portions further have opposed, substantially identically shaped outwardly curved portions 14 and 15 defining a second substantially cylindrically shaped gripping configuration of slightly larger size than the cylindrically shaped gripping configuration 13, and outwardly angularly directed insignia carrying portions 16 and 17 extend from the gripping configurations 14 and 15 to a pair of spaced apart, substantially parallel gripping portions 18 and 19, which terminate in opposed angularly inwardly directed free end portions 20 and 21. Additionally, the portion 18 has an outwardly formed V-shaped configuration 22 therein to facilitate gripping of a side edge of a two-by-two, as in FIG. 2, or to facilitate location and gripping of a pipe or the like, such as 23 in FIG. 3.

Figure 6:
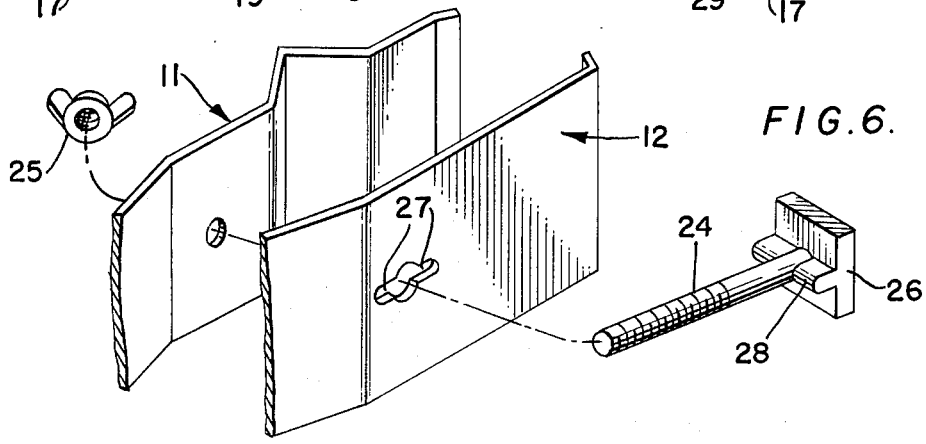
FIG. 6 is an enlarged, exploded, perspective, fragmentary view of a portion of the bracket of the invention showing the clamping or fastening means therefor.
Figure 7:
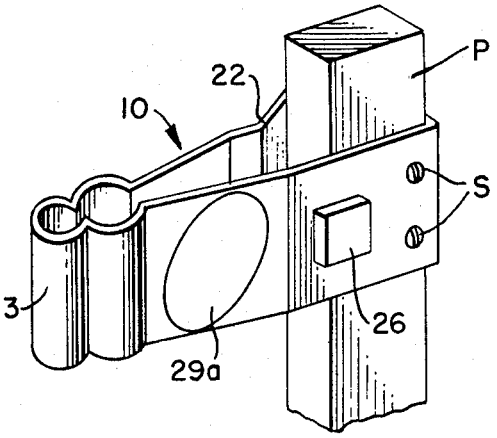
FIGS. 7, 8, 9 and 10 are perspective views similar to FIG. 1 of the bracket according to the invention, with further types of insignia thereon for indicating different types of intersections.

The bracket is preferably made of a suitable sheet material, such as stainless steel, plated steel, aluminum, brass or the like, or of synthetic plastic or other similar material, and has a natural resiliency, with the opposite side portions 11 and 12 thereof spaced apart, such as shown in FIG. 6, for example. In order to urge the opposite side portions toward one another and thus to bring the gripping configurations into secure gripping engagement with a support associated with the bracket, a suitable fastening means such as bolt 24 or the like is provided. The bolt 24 is extended through aligned openings in the opposite side portions of the bracket and a wing nut or other suitable threaded fastener 25 is threaded onto one end of the bolt. The other end of the bolt has a suitable head configuration 26 thereon.

As seen best in FIG. 6, the opening in one of the side portions 12 has slot formations 27 formed at opposite sides thereof for receiving a lug or projection 28 on the inner surface of the head 26 to prevent turning of the bolt 24 when the wing nut 25 is threaded on or off of the bolt. Thus it is not necessary to hold the head of the bolt while tightening or loosening it.

Figure 11:
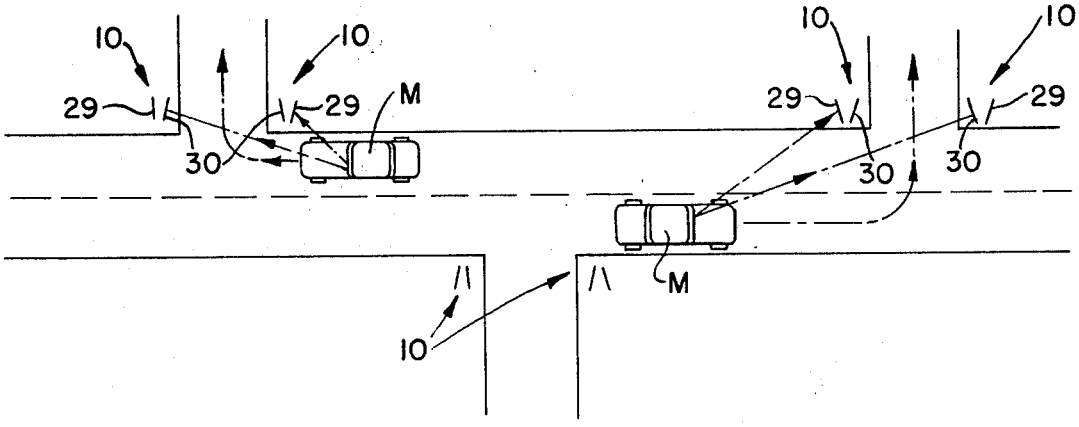
FIG. 11 is a schematic view of a portion of a roadway with intersecting roads and the placement of the bracket and insignia relative thereto to indicate to approaching motorists where the location of the intersection is and where the turn should be made.

The angularly inclined portions 16 and 17 of the opposite side portions have suitable indicia 29 and 30 thereon, such as reflectors or the like, for use of the bracket as a highway safety sign, as in FIG. 11, for example. The reflectors 29 and 30 may be painted on the inclined portions or glued thereon or otherwse suitably attached thereto in a well-known manner.

Also, one of the reflectors, such as 29, is preferably of a first color, such as green or the like, and the other reflector 30 is preferably of a second color, such as orange or the like. Thus, when used as in FIG. 11 a bracket 10 is provided at each of the opposite sides of an intersecting road or drive or the like, with the green reflectors on the outer sides of the brackets and the orange reflectors on the inner sides thereof. Accordingly, when a motorist M approaches the intersection, he will see a green reflector and an orange reflector and know that the turn is to be made between these two reflectors. This eliminates or obviates the necessity of the motorist attempting to see the intersecting roadway itself, which may be extremely difficult under adverse visual conditions.

Figure 4:
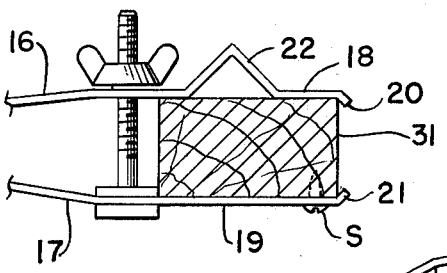
FIG. 4 is a fragmentary plan view of the bracket of the invention attached to a third type of support.
Figure 5:
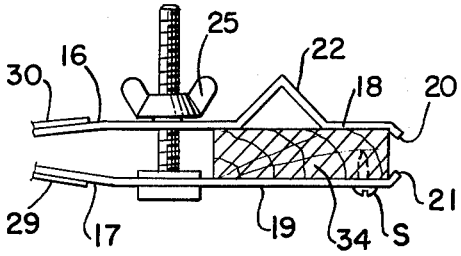
FIG. 5 is a view similar to FIG. 4, with the bracket attached to a fourth type of support.
Figure 8:
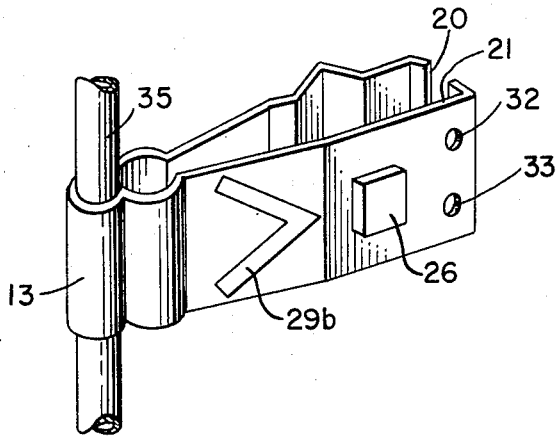
Figure 9:
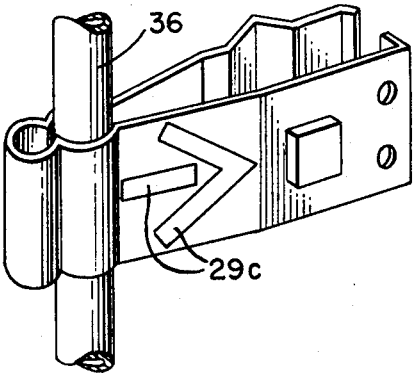
Figure 10:
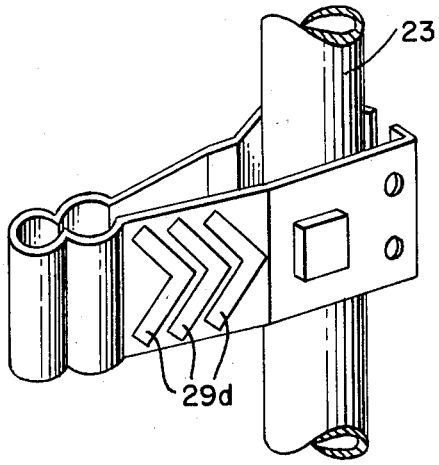

The bracket is shown attached to a two-by-four or the like 31 in FIG. 4, and suitable fasteners, such as screws S or the like, may be extended through openings 32 and 33 in the side portion 19 into the two-by-four to aid in securing the bracket in position. Similarly, in FIG. 5 the bracket is shown attached to a support such as a one-by-four or the like 34. In FIG. 8 the bracket is shown attached to a support such as a one-half inch steel rod or the like 35 received in the end gripping configuration 13, and in FIG. 9 the bracket is attached to a support such as a conventional one-half inch pipe or the like 36 received between the configurations 14 and 15. In FIG. 10 the bracket is attached to a support, such as 1-½ inch pipe or the like 23.

As indicated in FIGS. 7–10, various types of insignia may be used on the bracket to indicate different types of intersections. For example, in FIG. 7 a disc **29*a* could be used to indicate a private road or drive; in FIG. 8 a single chevron 29*b* could be used to indicate a county road or city street; in FIG. 9 a single chevron with a bar 29*c* could be used to indicate a state road or major city street or avenue; and in FIG. 10 three parallel chevrons 29*d*** could be used to designate major U.S. highways or four-lane roads and the like.

In addition to the different shapes of insignia, the insignia could be of different sizes. For example, disc **29*a* could have a diameter of approximately 2 inches; chevron 29*b* could have an overall height of about 5 inches; chevron bar 29*c* could have a height of about 8 inches; and the triple chevron arrangement 29*d* of FIG. 10** could have a height of about 12 inches.

As this invention may be embodied in several forms without departing from the spirit or essential characteristics thereof, the present embodiment is, therefore, illustrative and not restrictive, since the scope of the invention is defined by the appended claims rather than by the description preceding them and all changes that fall within the metes and bounds of the claims or that form their functional as well as conjointly cooperative equivalents are, therefore, intended to be embraced by those claims.

I claim:

1. A universal mounting bracket for attachment to supports of various configurations and sizes, comprising opposite side portions integrally joined together at one of their ends with a first, substantially cylindrically shaped support gripping configuration for receiving a cylindrically shaped support therein and a second substantially cylindrically shaped gripping configuration of larger diameter than said first gripping configuration and adjoining same, said side portions being spaced apart at their other ends to grip different size and shape supports to enable the bracket to be quickly and easily mounted on various supports, and the side portions including essentially parallel gripping surfaces thereon, each having one free end forming one of said side portion other ends and having another end disposed toward said joined ends, and angularly disposed planar surfaces connected to said parallel gripping surfaces and extending toward said joined ends, said angularly disposed surfaces being connected to said second gripping configuration and carrying thereon desired insignia, whereby to increase the visibility of the insignia to approaching motorists and the like, and connecting means for connecting together said parallel gripping surfaces.

2. A mounting bracket as in claim 1, wherein said fastening means is located nearer said another end of each of said parallel gripping surfaces than to said free end thereof for urging the opposite side portions and said parallel gripping surfaces toward one another so that said parallel gripping surfaces are forced into secure gripping engagement with said support.

3. A mounting bracket as in claim 2, further including an outwardly directed V-shaped gripping configuration located in one of said parallel gripping surfaces between the ends thereof, defining another gripping configuration for receiving and gripping a corner of a polygonally-shaped support or one side of a cylindrically-shaped support and the like.

4. A mounting bracket as in claim 3, wherein the insignia comprises a reflective material on the angularly disposed portions, the angular disposition of the angularly disposed portions being such that when the bracket is mounted on a support adjacent a roadway or the like, incident light on the reflective material is reflected back toward the source of the light and is thus highly visible to a motorist or the like approaching the bracket.

5. A mounting bracket as in claim 4, wherein the fastening means comprises an elongate bolt having a head end disposed against an outer surface of one of the side portions and a threaded end extended through a hole in the other side portion, a wing nut threaded onto said other end of the bolt against the outer surface of said other side portion, and a rib on said bolt head disposed in a slot in said one side portion to prevent turning of said bolt when said wing nut is threaded relative to the bolt.

6. The mounting bracket as in claim 1 further including inwardly directed opposed portions on said free ends.

* * * * *